United States Patent [19]

Odell

[11] 4,062,262

[45] Dec. 13, 1977

[54] SLICING MACHINES

[75] Inventor: John Anthony Odell, London, England

[73] Assignee: Lemonaid Limited, Hennslow, England

[21] Appl. No.: 717,013

[22] Filed: Aug. 23, 1976

[30] Foreign Application Priority Data

Sept. 23, 1975 United Kingdom ..... 38925/75

[51] Int. Cl.[2] ..... B26D 4/22; B26D 7/06

[52] U.S. Cl. ..... 83/717; 83/411 A; 83/733

[58] Field of Search ..... 83/703, 707, 717, 409.2, 83/411 A, 733, 205, 247, 267, 268

[56] References Cited

U.S. PATENT DOCUMENTS

| | | | |
|---|---|---|---|
| 2,280,053 | 4/1942 | Barnes | 83/733 X |
| 3,693,684 | 9/1972 | Bettcher | 83/733 |
| 3,782,230 | 1/1974 | Bettcher | 83/733 X |
| 3,985,057 | 10/1976 | Bettcher | 83/733 X |

*Primary Examiner*—Willie G. Abercrombie

*Attorney, Agent, or Firm*—Larson, Taylor and Hinds

[57] ABSTRACT

A slicing machine has a vertically extending semi-cylindrical cassette carrying objects to be sliced. A motor rotates a horizontal cutting blade and in addition swings the cassette about a vertical axis so that an object in the cassette is swept past the blade. The machine has an opening in its base to allow slices to fall out. On operation of a starter switch the motor functions for one revolution of the cassette. The switch is positioned so that it can be operated by a receptacle offered up to the opening.

8 Claims, 3 Drawing Figures

Figure 1:
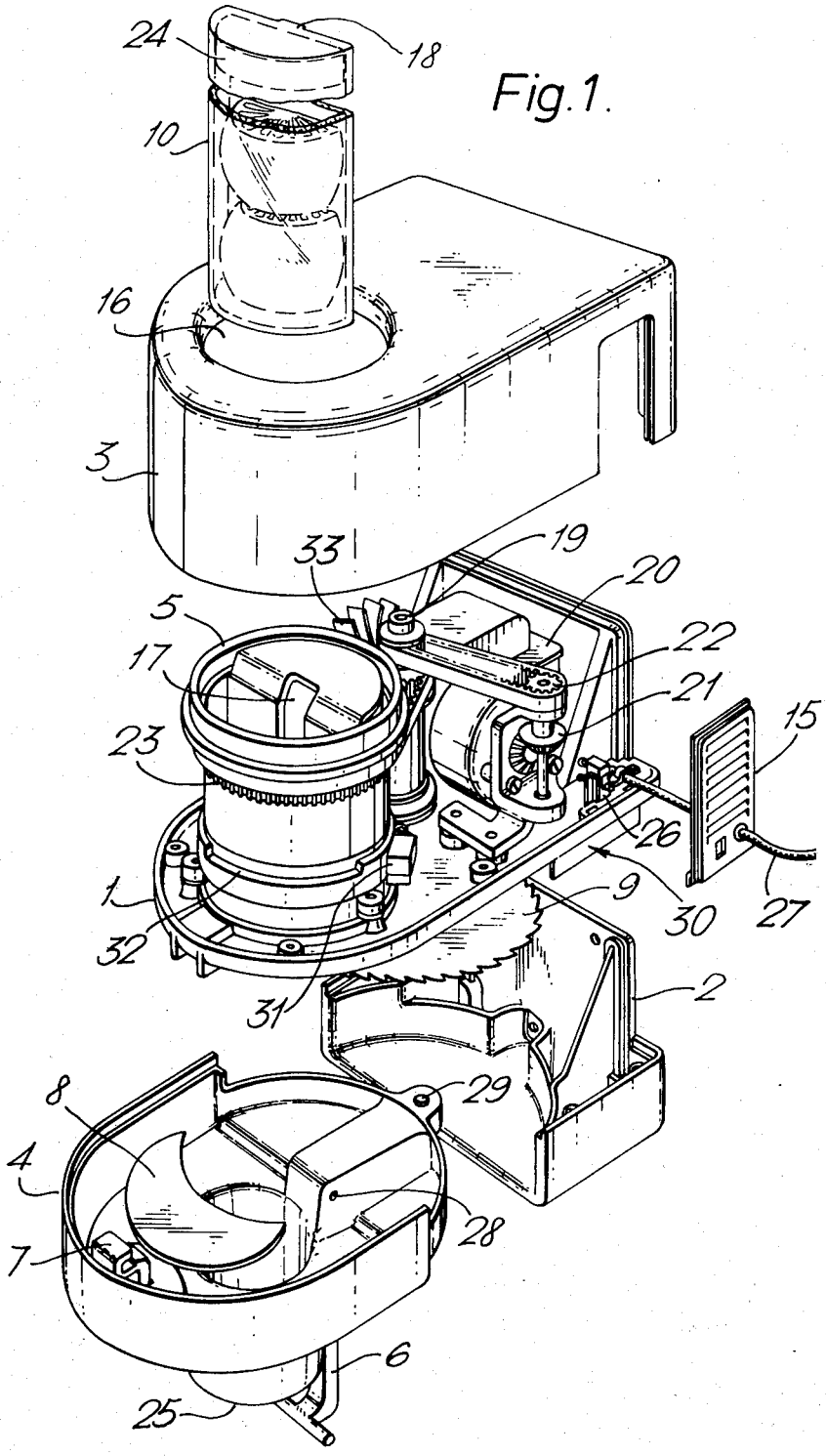

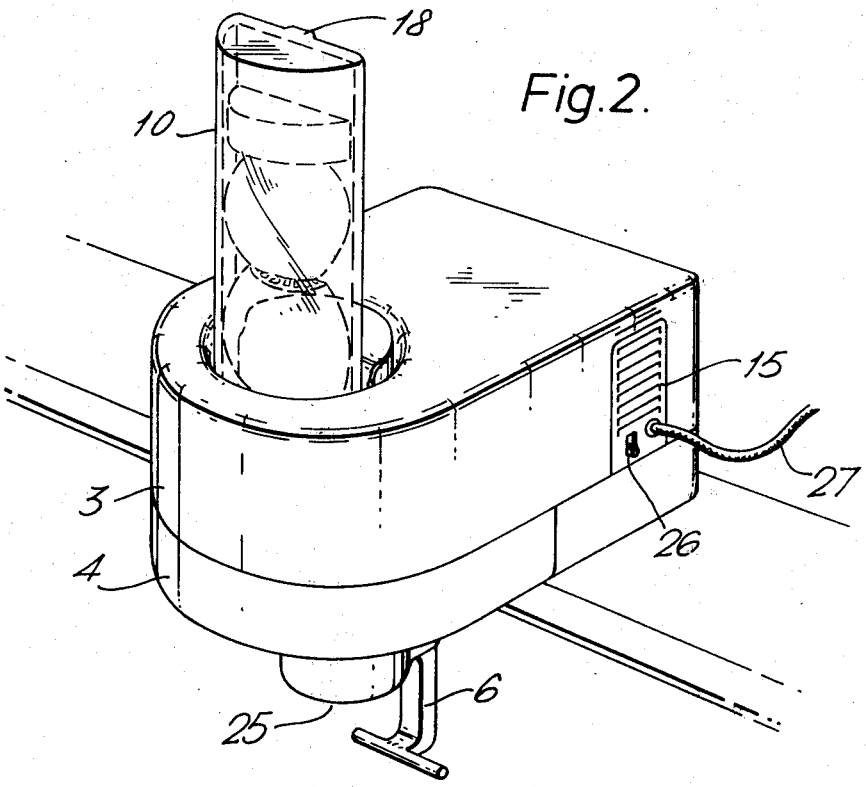
Fig.2.
Fig.3.
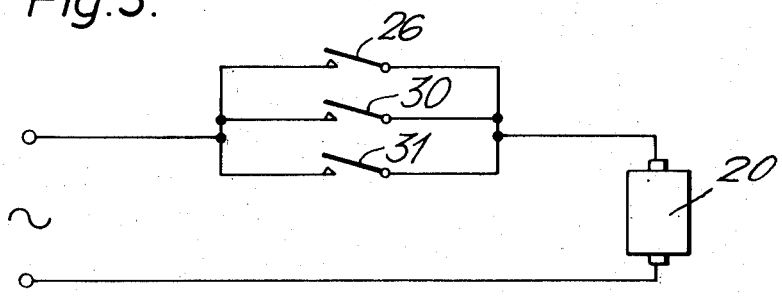

SLICING MACHINES

This invention relates to slicing machines, particularly for slicing small objects. It has application in the slicing of items of food, especially fruit such as lemons for example.

It is an object of the invention to provide a slicing machine which is simple to operate, hygienic and safe.

According to the present invention a slicing machine comprises a cassette extending along one dimensional axis and open at least at one end of said axis and designed to hold objects to be sliced, a cutting blade, and drive means for rotating the cassette about an axis parallel to the said dimensional axis and offset therefrom so as to carry any object projecting proud of the said open end past the cutting blade and return the cassette to its original position.

Preferably the cutting blade is a rotary blade mounted to rotate about an axis parallel to the axis of rotation of the cassette and the said drive means may conveniently be coupled to rotate the blade.

In carrying out the invention switch means may be included to energise the drive means for a single complete rotation of the cassette and then de-energise the drive means so as to produce a single slice for each operation of the switch means.

In a preferred embodiment the cassette is arranged to be mounted vertically with the said open end at the bottom and an opening is provided beneath the machine for allowing a slice that is cut to fall out. Conveniently the switch means is positioned to be energised by an appropriate movement of a receptacle for the slice which is offered up to the opening.

In order that the invention may be more fully understood reference will now be made to the drawings accompanying this Specification in which:

FIG. 1 illustrates in perspective an exploded view a machine embodying the invention, FIG. 2 is a perspective view of the assembled machine; and FIG. 3 is a diagram of the electric circuit for the machine.

Referring now to FIG. 1 there is shown therein a machine comprising a chassis plate 1 designed to be held by a wall or shelf fixing bracket 2. A cover 3 fits over chassis plate 1 and a tray 4 is secured underneath plate 1 by a catch 7.

Chassis plate 1 carries a generally cylindrical cassette holder 5 mounted for rotation about its central axis. Cassette holder 5 has a space of semi-circular cross-section into which a semi-cylindrical cassette 10 is designed to fit after passing through a hole 16 in cover 3. To assist in securely locating cassette 10 in cassette holder 5 the latter has a slot 17 along which a co-operating projection 18 in the flat face of cassette 10 slides. It will thus be seen that when cassette holder 5 is rotated about its own axis it causes cassette 10 to rotate about an axis parallel to the vertical axis of the cassette.

Beneath chassis plate 1 there is mounted a rotary cutting blade 9 secured to a vertical shaft 19. An electric motor 20 is mounted on chassis plate 1 with its drive spindle horizontal and is coupled through right-angle gearing 21 and a drive belt 22 to rotate shaft 19 and thus with it blade 9. Cassette holder 5 is coupled to shaft 19 through a further belt drive 23 so that energisation of the motor causes cutting blade 9 and cassette holder 5 to rotate simultaneously. Alternatively motor 20 may be mounted with its axis vertical and may be directly coupled to shaft 19.

Objects to be sliced are inserted in cassette 10 which is then fitted into cassette holder 5. Beneath cassette 10 there is positioned a gauge plate 8 which acts as a stop for any object lying at the bottom of cassette 10 and determines the distance by which such an object emerges proud of the open end of cassette 10. To ensure that objects are held well down a weight 24 may be provided in cassette 10 to apply downward pressure. The thickness of any slice depends on the vertical separation of gauge plate 8 and blade 9.

When motor 20 is energised cassette holder 5 rotates causing any object in cassette 10 which rests against gauge plate 8 to be carried round past the rotating cutting blade 9 and be sliced thereby. The slice so produced falls through an opening 25 in the bottom of tray 4. The motor may be continuously energised by means of a manual switch 26 positioned at the side of tray 1 which, as shown in FIG. 3, directly connects motor 20 to an incoming supply on flexible cable 27. When switch 26 is closed motor 20 continuously operates and a continuous series of slices is produced at the rate of one slice per revolution of cassette holder 5 until all the objects in cassette 10 have been sliced up.

The machine is also arranged to enable single slices to be delivered and to this end a trigger arm 6 is provided beneath opening 25. This trigger arm comprises a lever pivotted about a point 28 in tray 4 and the end 29 of the lever is moved upwards to operate a microswitch 30 positioned underneath tray 1. As shown in FIG. 3 microswitch 30 is connected in parallel with switch 26 so that movement of trigger arm 6 in a horizontal direction causes energisation of motor 20 and thus cassette holder 5 and blade 9 commence to rotate and slicing action starts for as long as trigger arm 6 is displaced. To maintain energisation of motor 20 after trigger arm 6 is released another microswitch 31 is provided which is mounted close to the side of cassette holder 5 and co-operates with a cam 32 positioned around its periphery. After cassette holder 5 is turned through a small angle cam 32 operates microswitch 31 to maintain the energisation of motor 20 after release of trigger arm 6. Accordingly the cassette holder 5 will continue to rotate and slicing action continues until cassette holder 5 completes one revolution whereupon cam 32 is so shaped that switch 31 opens and de-energises the motor. In this mode only a single slice is produced and a second slice can only be provided upon subsequent operation of trigger arm 6. In order to ensure that cassette holder 5 makes as near an exact single revolution as possible motor 20 is provided with an electron-ognetic brake which is applied when the motor is de-energised to ensure an accurate stopping position. Energisation of the motor releases the brake.

Motor 20 can be cooled by a fan 33 mounted to rotate therewith and a grill 15 provided in the side of cover 3. In addition motor 20 may be provided with a thermal cut-out.

In use of the machine cassette 10 is loaded with objects to be sliced. If these are lemons for example they may be prepared for the machine by removing their top and bottom tips and then halving them the resulting halves being then loaded sequentially in the cassette.

To obtain a slice of lemon a receptacle such as a tumbler is offered up beneath opening 25 and momentarily pushed against arm 6. This allows the machine to start and the pressure against arm 6 can then be removed. The machine will continue to operate until the cassette has completed one revolution and then it will stop, meanwhile delivering a slice of lemon into the receptacle. If a number of slices is required the side switch 26 is operated and not arm 6 whereupon the machine functions to deliver slices until switch 26 is switched off. In view of the action of cam 32 and switch 31 the machine will always continue to operate after switch 26 is opened until the cassette finishes a revolution and returns to its starting position as shown in FIGS. 1 and 2.

In order to prevent the possibility of cutting edge of blade 9 being reached through opening 25 gauge plate 8 and chassis plate 1 may be appropriately shaped.

I claim:

1. A slicing machine comprising a housing containing a rotatable cassette holder, a vertically extending cassette fitting into said cassette holder and which is open at its bottom end and is designed to hold objects to be sliced, a horizontal cutting blade, drive means for rotating the cassette holder about a vertical axis so as to sweep the cassette through a circular path and carry any object projecting proud of the bottom end of the cassette past the cutting blade and return the cassette to its original position, and coupling means between said drive means and said cassette holder positioned so as to provide an unobstructed space beneath the cassette holder for any slice cut by the blade, and said housing having an opening positioned beneath the blade for allowing such slice to fall out.

2. The machine as claimed in claim 1 in which the cutting blade is a rotary blade mounted to rotate about an axis parallel to the axis of rotation of the cassette.

3. The machine as claimed in claim 2 in which the said drive means is coupled to rotate the blade.

4. The machine as claimed in claim 1 in which switch means is included to energise the drive means for a single complete rotation of the cassette and then de-energise the drive means to produce a single slice for each operation of the switch means.

5. The machine as claimed in claim 4 in which the switch means is positioned to be energised by movement of a receptacle for a slice when offered up to the opening.

6. The machine as claimed in claim 1 in which the cassette holder has a cylindrical shape and the cassette has a semi-cylindrical shape and the axis of rotation of the cassette holder coincides with the axis of the cylinder so that rotation of the cassette holder causes the cassette to sweep out a cylinder of rotation.

7. The machine as claimed in claim 1 in which the coupling means couples the drive means to the cassette holder through the outer circumference of the cassette holder.

8. The machine as claimed in claim 1 in which a gauge plate is positioned beneath the cassette but so as not to be overlayed by the cutting blade, which plate determines the distance by which any object is allowed to project proud of the bottom end of the cassette and the vertical distance of the gauge plate below the blade corresponds to the thickness of a slice that is cut.

* * * * *